US006073699A

United States Patent [19]

Hollingsworth, Jr.

[11] Patent Number: 6,073,699

[45] Date of Patent: Jun. 13, 2000

[54] SINGLE JOINT ELEVATOR

[75] Inventor: Jimmy L. Hollingsworth, Jr., Langenhagen, Germany

[73] Assignee: Weatherford/Lamb, Inc., Houston, Tex.

[21] Appl. No.: 09/036,271

[22] Filed: Mar. 6, 1998

[51] Int. Cl.[7] ..... E21B 19/06

[52] U.S. Cl. ..... 166/379; 166/77.52

[58] Field of Search ..... 166/379, 380, 166/77.52, 77.51, 85.1

[56] References Cited

U.S. PATENT DOCUMENTS

| | | | |
|---|---|---|---|
| 1,021,984 | 4/1912 | Holmes | 294/90 |
| 1,113,659 | 10/1914 | Lebus | 166/77.52 |
| 1,371,835 | 3/1921 | Angus | 294/90 |
| 1,448,100 | 3/1923 | Wigle . | |
| 1,454,194 | 5/1923 | Thomas . | |
| 1,842,638 | 1/1932 | Wigle . | |
| 1,844,379 | 2/1932 | Campbell . | |
| 2,287,507 | 10/1942 | Penick et al. | 294/102 A X |
| 2,661,979 | 12/1953 | Stone . | |
| 3,037,803 | 6/1962 | Phillips . | |
| 3,140,523 | 7/1964 | Taylor, Jr. . | |
| 3,193,116 | 7/1965 | Kenneday et al. . | |
| 3,287,776 | 11/1966 | Brown | 294/90 X |
| 3,330,354 | 7/1967 | Chamblee | 166/313 |
| 3,351,372 | 11/1967 | Marks et al. | 294/81 |
| 3,403,791 | 10/1968 | Marks et al. . | |
| 4,354,706 | 10/1982 | Coyle, Sr. | 249/102 A |
| 4,834,441 | 5/1989 | Schivley | 294/90 |
| 5,755,289 | 5/1998 | Angman et al. | 166/378 |
| 5,848,647 | 12/1998 | Webre et al. | 166/379 |

FOREIGN PATENT DOCUMENTS

| | | | |
|---|---|---|---|
| 0 171 144 | of 1986 | European Pat. Off. . | |
| 0171144A | 2/1986 | European Pat. Off. . | |
| 1497666A | 10/1967 | France . | |
| 1286729 | 1/1987 | U.S.S.R. | 166/77.52 |
| PCT/GB80/ 00196 | of 1980 | United Kingdom . | |

OTHER PUBLICATIONS

BJ Oilfield Products & Systems, pp. 37, 42, 46, 49, 51, 53, 54, 55; 1986.

*Primary Examiner*—William Neuder
*Attorney, Agent, or Firm*—Guy McClung

[57] ABSTRACT

A new elevator for use in wellbore operations has been invented which, in certain aspects, has a first body part, a second body part, the body parts together defining a interior opening through the elevator for accommodating a wellbore tubular therein, first hinge apparatus hingedly connecting the two body parts together and permitting the two body parts to be hingedly openable on a first side of the elevator, and second hinge apparatus disposed across from the first hinge apparatus, the second hinge apparatus hingedly connecting the two body parts together and permitting the two body parts to be hingedly openable on a second side of the elevator. In certain aspects such an elevator has at least one roller secured to an interior of at least one of the body parts to facilitate movement of a wellbore tubular with respect to the elevator, and inparticular aspects has a plurality of spaced apart rollers. In one such elevator the plurality of rollers is one or more rollers on each body part.

3 Claims, 3 Drawing Sheets

FIG. 1C
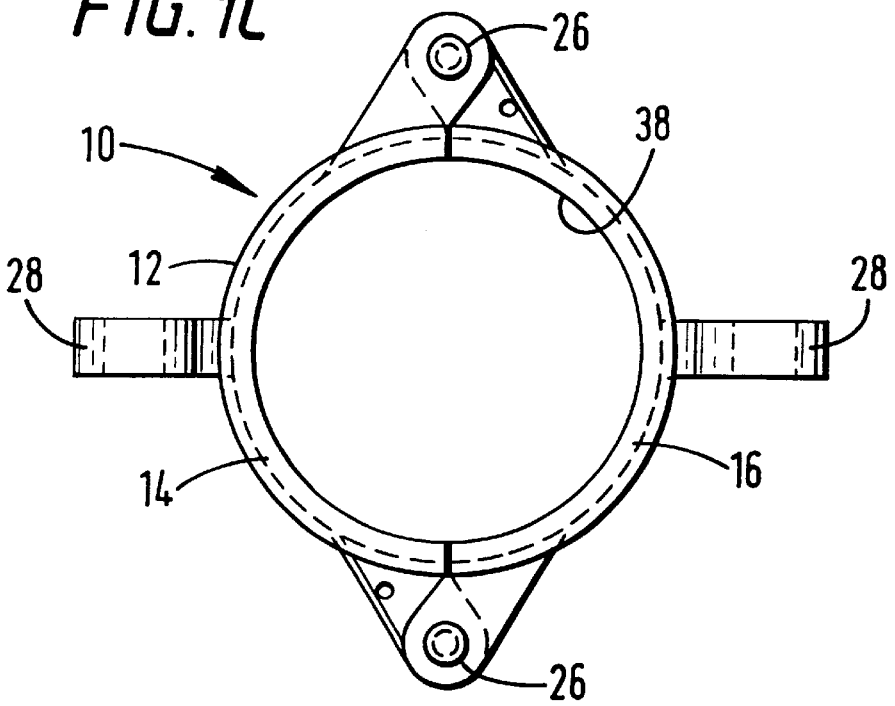
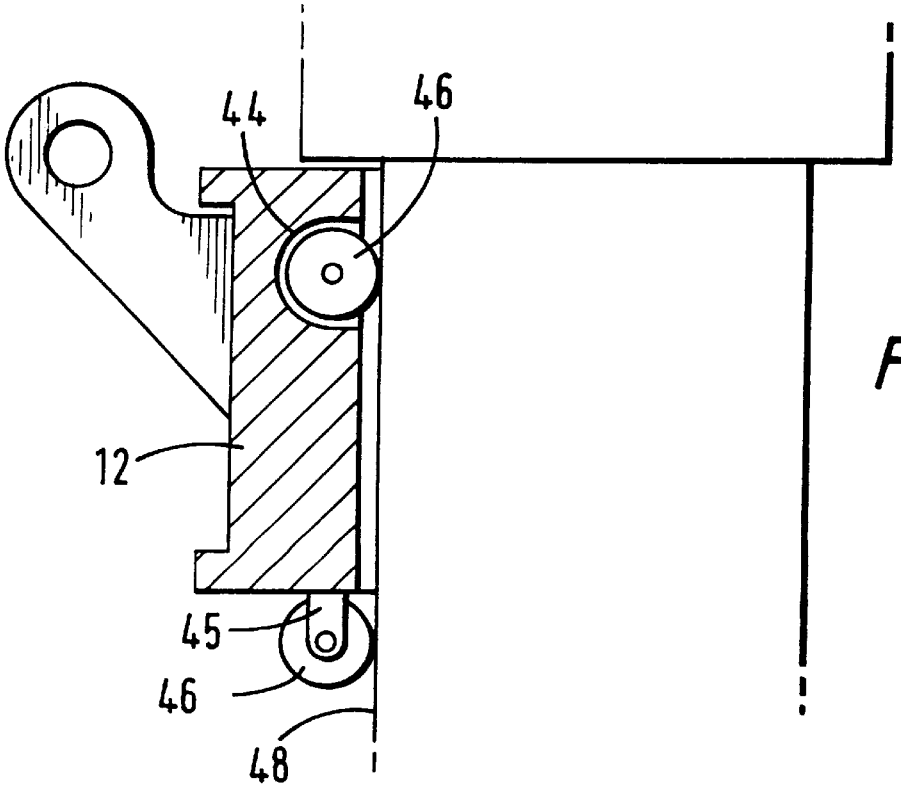
FIG. 2

SINGLE JOINT ELEVATOR

BACKGROUND OF THE INVENTION

While running a string of casing or tubing one of the crew works thirty to forty feet above the rig floor secured to the rig by a safety cable. He is known as the stabber and his is arguably the most physically demanding and potentially dangerous job on a casing crew.

The stabber plays an extremely important role in the process of installing a string of tubulars in a well. To the casual observer his functions are limited to alignment of the pipe threads so that the coupling of two joints is possible. But, although this is an integral part of his job, he must accomplish other tasks before the pipe can be lowered into the well. These tasks include:

opening the single-joint elevator, guiding the swivel to the correct side of the string, communicating to the driller the proper setting position of the string elevator, closing the string elevator, and finally signaling to the driller that the string elevator is properly set.

He generally works thirty to forty feet above the rig floor on a stabbing board, secured to the rig by a safety cable. Couple this unfavorable position with a physically strenuous task which requires constant attentiveness and one can see how easily problems can develop.

Surveys have shown that pipe handling is one of the most hazardous operations for rig personnel. Experience has shown that the stabber is involved in many of the accidents that arise and unfortunately also in many of the fatalities. Furthermore, the stabber is involved in incidents where strings of pipe are dropped due to miscommunication with the driller, improper setting of the string elevator on the collar, etc.

There are new or newly rebuilt rigs today which have pipe handling systems that are capable of operating without a stabber under certain conditions. But, the vast majority of today's operating rigs do not have such systems. The costs associated with these systems are significant; furthermore, the driving force for the contractor is to bid a rig at the cheapest rate complying with as many requirements as possible.

SUMMARY OF THE PRESENT INVENTION

Due to the inherent danger of the stabber's job along with the industry's ongoing pursuit of accident reduction, a system was developed to eliminate the need for the stabber without requiring major rig modifications or new construction. This system incorporates all of the stabber's functions using a combination of both new equipment and existing tools that have been modified. A mechanized stabbing device, air-operated elevator and spider with an integrated safety interlock system, a flagging device and a redesigned single-joint elevator compose the system. The mechanized stabbing device and elevator and spider with safety interlock system have been used with great success in the running of casing and tubing in the Gulf of Mexico and North Sea. Trials on a test rig have been completed on the single-joint elevator and flagging device and both are awaiting field trails as of the submission date. With the introduction of this system, safety and reliability during pipe running operations will be greatly enhanced and from this will follow the economic benefits.

A cost-effective system that eliminates the need for a stabber, requiring little or no rig modification, is described.

The primary physical job of the stabber is to align the threads of an upper joint so that it may be coupled by means of thread engagement to the pipe string already suspended in the well. Some drilling personnel in the industry find it easily justifiable, due to the physical output required and safety issues, to use a machine to perform the thread alignment on larger diameter pipe (13⅜" and above).

In certain aspects the present invention provides systems that are:

Lightweight

Easily installed and adaptable to different rigs

2⅜"–20" range

Operable from the rig floor

Explosion Proof electrical components

The resulting mechanized stabbing device is a machine capable of running pipe sizes from 2⅜" to 20". Sizes of up to 36" have since been incorporated. It is lightweight, roughly 1000 pounds, and is easily mounted in a derrick. It has four degrees of freedom: in/out and left/right in the horizontal plane (the stabbing functions), up/down to remove itself for lowering the pipe string and open/close the doors. Extension capability is 40" and the rotational function provides a minimum operational area of 36" in diameter around well center.

An electronic control system equipped with programmable logic controller (PLC) accepts input from a remote control panel carried by the operator and converts these inputs to outputs at the mechanized stabbing device. The remote control is a lightweight device incorporating an ergonomical joystick from which all functions of the stabbing device can be actuated without the need for the operator to search for buttons. Proportional capability is provided for the stabbing functions to give the operator finer control during positioning. Also featured in the system is the ability to store and automatically return to preset positions such as the stabbing position and parked (retracted) position. This allows for a joint of pipe to be moved to the stabbing position with the push of a button and then, after makeup, retracted with the push of a button. Positional output into an anti-collision system is also possible. The main control panel, remote control and solenoids of the hydraulic control value conform to U.S. and European hazardous area restrictions.

The hydraulic control value accepts power from both fixed and variable displacement power units thus allowing rig hydraulics to be used if so desired. It can also be manually overridden if an electrical failure is experienced.

Spider and Elevator with Safety Interlock System

Air operated spiders and elevators have been commonly used in the industry for some time now. These tools remedied the need for manual force to open and close the large slip bodies, but provided no means of ensuring that the slips were set properly on the pipe body nor the ability of remote operation. Incidents of setting the elevator on the collar and subsequently dropping strings of pipe still occurred.

In 1994, responding to demands by a customer to remedy the problem, a system was designed that prevents the elevator and spider from being simultaneously open. The system pneumatically links the elevator and spider and senses the slip position of both tools. Unless the elevator is set on the pipe body, it is impossible to open the spider, and vice-versa. Setting of the slips on the collar is sensed as being open. The system has since been upgraded so that it also senses the absence of pipe when the slips are in a closed position and is controlled from a remote panel on the rig floor. It can also be overridden, by activating key-protected switches, to comply with special operational situations.

With the advent of the hydraulically-powered flush-mounted spiders it has become increasingly important that this system be used. Hydraulic power makes it possible to overcome string weight and open the spider where it was not possible with pneumatically-powered tools.

The remotely-operated elevator and spider with safety inter-lock system not only provides the ability to control a function which was previously the stabber's from the rig floor, but also increases safety and reliability.

Flagging Device

An often overlooked function of the stabber is to flag the driller to stop lowering the elevator when it is in the correct position to be closed. Even though the safety interlock system will prevent the opening of the spider if the elevator is closed in an incorrect position, it is desirable to have a constant height from the rig floor to the collar once the string has been lowered into the well. This enables the long operator to work at a somewhat constant height when making up each joint. Furthermore, when a stabber is not present to deliver this signal, it is highly desirable for the driller to have a positive confirmation of setting position.

A proposed solution was to use a wheel to detect collar position. The wheel is mounted to the top of the elevator and is radially displaced by the emergence of the pipe through the elevator. Radial displacement actuates a pneumatic valve that allows air to be fed to the open/close function of the elevator thereby achieving the interlock feature.

The current device also uses a radially displaceable wheel that is actuated by the coupling emerging through the elevator. It can be mounted to either the elevator or the bails. Radial displacement activates a pneumatic valve that allows air to flow to a cylinder providing a visual signal to the driller that he is in the correct position to close the elevator.

Single-Joint Elevator

A challenging job to overtake from the stabber is that of opening and closing the single-joint elevator (SJE). Safety is a main concern in this aspect and strict limits were imposed on how the SJE should function. Accidental opening of a pneumatically-actuated SJE, along with concerns of excessive weight, eliminated this possibility very early in the design phase and led to a device which could only be opened or closed manually at the rig floor.

When the SJE is allowed to remain latched on the pipe, means are required to pull the swivel to the side so that it will clear the pipe when lowered. If a standard SJE design were used another requirement would be to ensure that the swivel was pulled to the hinge side of the SJE rather than the latch side. Positioning of the swivel on the latch side results in the SJE being unreinovable from the joint. To eliminate this further complication a SJE was designed that can be opened from either side. Elastic straps are attached from the string elevator to the slings at a point just above the swivel. Generally, the elevator and straps are positioned so that the swivel is pulled to the V-door when the weight of the pipe is relieved from the SJE. Once the pipe is made up and the string lowered, the pin of the SJE opposite the V-door is pulled to remove the SJE from the pipe. It is then carried to the V-door and latched on the next joint.

The combination of these components results in a system that provides for the handling of pipe from the time it leaves the V-door until it is connected with the string and lowered into the well. A majority of the functions required to complete this process will be done without the need for manual intervention and will be controlled from a remote location on the rig floor. The system will be modular thus allowing the operator to tailor it to his specific requirements.

Starting at the V-door, the SJE is latched on the pipe and the pipe is raised to a horizontal position by the block. The mechanized stabbing device is then lowered to its horizontal, or working, position, encircling the pipe in its head and moving it to a preprogrammed well center position. The pin of the pipe is lowered into the box and the makeup process begins with the swivel allowing the SJE to rotate with the pipe. Once the string elevator is lowered and weight of the joint is removed from the SJE, the elastic straps pull the swivel towards the V-door and the SJE slides down the pipe. At final makeup the elevator is at a position over the joint of pipe where the signal has been given from the flagging device. After makeup has been completed the elevator is remotely closed and assumes the string weight. The spider is remotely opened and the string is lowered in the well. Once the SJE is at rig-floor level it is unlatched and carried to the V-door to pick up the next joint. The transfer of the string from elevator to spider is completed and the cycle repeats itself.

It is, therefore, an object of at least certain preferred embodiments of the present invention to provide:

New, useful, unique, efficient, non-obvious wellbore tubular elevators and methods of their use;

Such elevators with a two part body with parts of the body hinged on each side of the elevator; and Such elevators whose use simplifies the handling of tubulars in a rig.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previously-mentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 1C is a top view of the elevator of FIG. 1A.

FIG. 2 is a partial side view of an elevator according to the present invention.

DESCRIPTION OF EMBODIMENTS PREFERRED AT THE TIME OF FILING FOR THIS PATENT

Figure 1A:
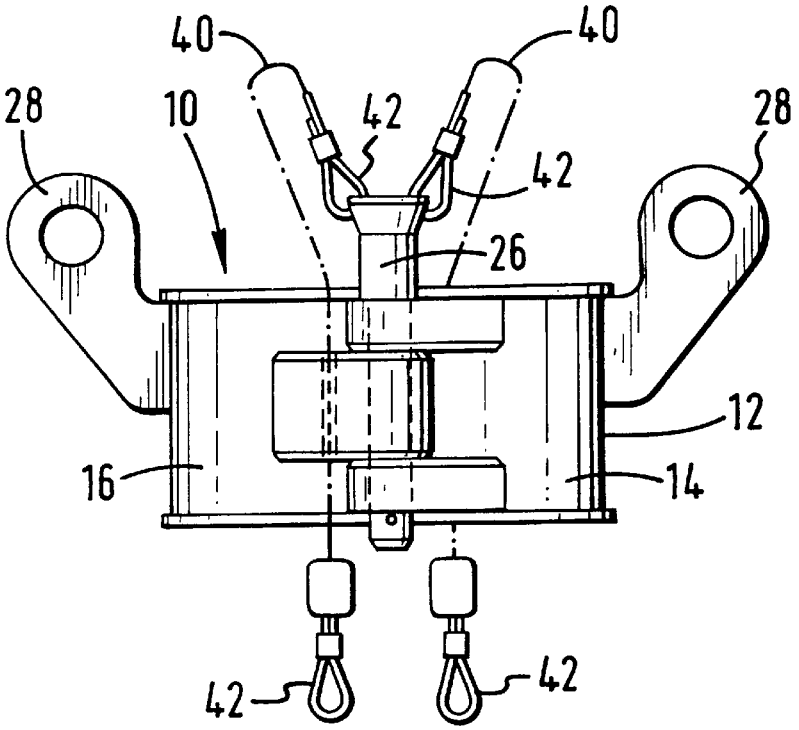
FIG. 1A is a side view of an elevator according to the present invention.
Figure 1B:
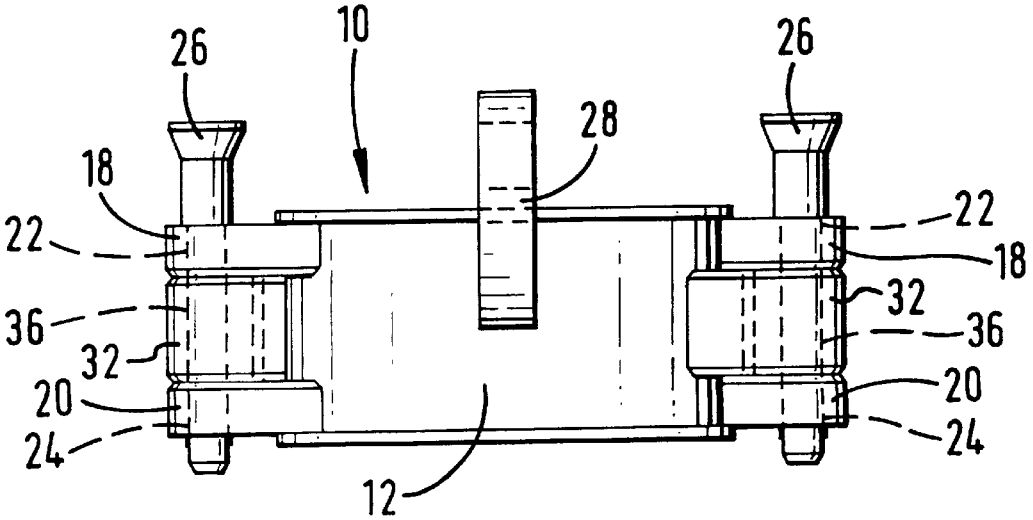
FIG. 1B is a side view from another side of the elevator of FIG. 1A.

Referring now to FIGS. 1A–1C, an elevator 10 according to the present invention has a body 12 with two parts 14 and 16 which are dually hinged together. Each part has bosses 18 and 20, respectively, with channels 22 and 24 therethrough, and bosses 32 and 34, respectively, with channels 36 therethrough through which are removably inserted pins 26. Lifting ears 28 are on each side of the body 12. Thus the elevator may be selectively opened from either side as desired. Elastic straps or cables or wires 40 with connectors 42 are connected to each pin 26 may be used to move the elevator and/or to move the pins 26. A tubular resides in an opening 38 defined between inner surfaces of the two parts 14 and 16.

As shown in FIG. 2, in one aspect an elevator according to the present invention may have rollers 46 rotatably mounted to a part of the body 12 to facilitate tubular movement of a tubular 48 with respect to the elevator.

Figure 3:
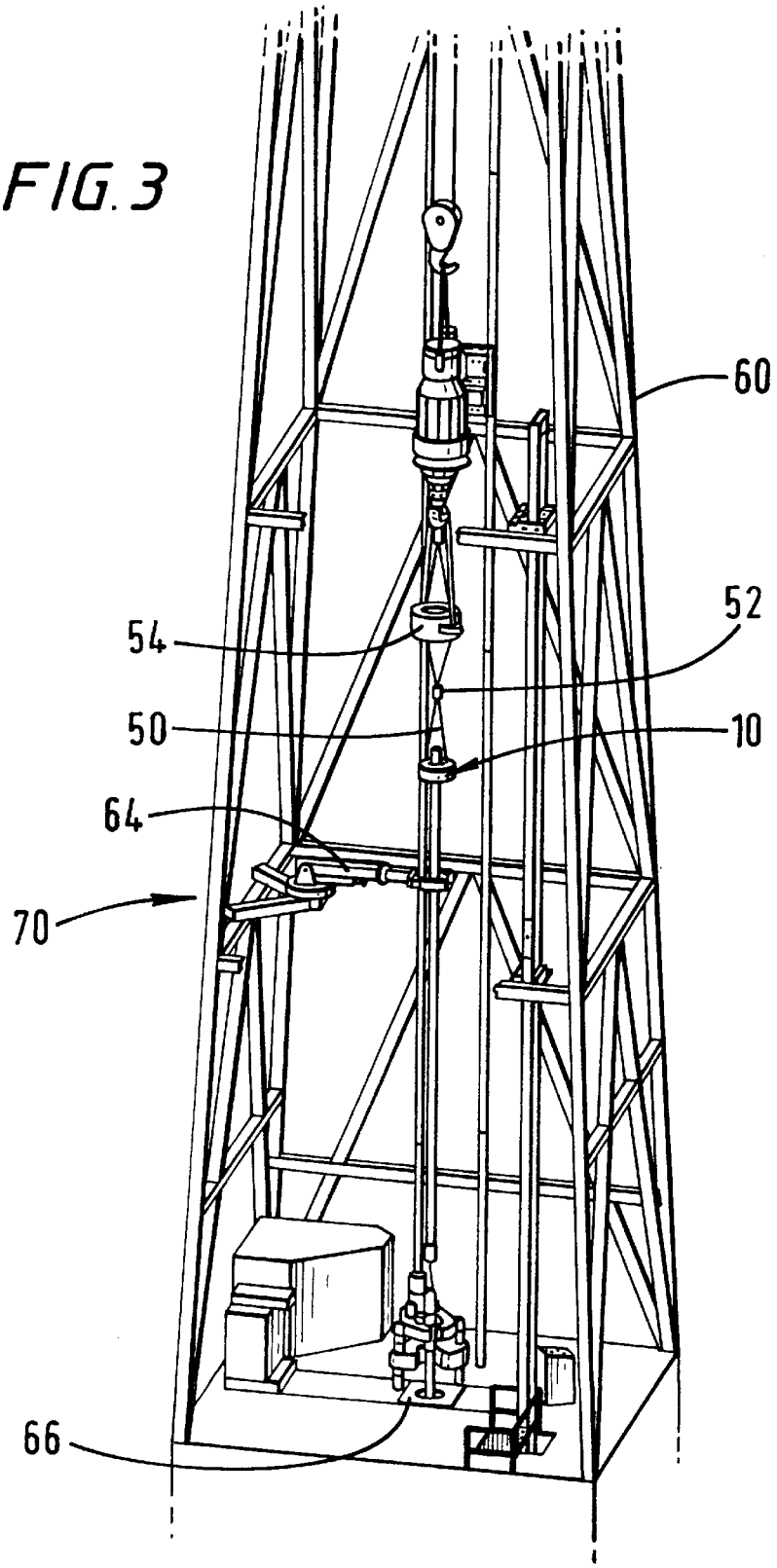
FIG. 3 is a perspective view of a system according to the present invention.

Referring now to FIG. 3, an elevator 10 is shown positioned in a rig 60 with elastic straps 50 connecting the elevator 10 to a swivel 52 and with straps 54 connecting the swivel 52 to a string elevator 56. A system 70 as shown in FIG. 3 according to the present invention includes a mechanized stabbing device 64 secured to the rig 60 and a remote controlled spider 66 with a safety interlock system.

The present invention, therefore, provides an elevator for use in wellbore operations which a has first body part, a second body part, the body parts together defining an interior opening through the elevator for accommodating a wellbore tubular therein, first hinge apparatus hingedly connecting the two body parts together and permitting the two body parts to be hingedly openable on a first side of the elevator, and second hinge apparatus disposed across from the first hinge apparatus, the second hinge apparatus hingedly connecting the two body parts together and permitting the two body parts to be hingedly openable on a second side of the elevator; such an elevator with at least one roller secured to an interior of at least one of the body parts to facilitate movement of a wellbore tubular with respect to the elevator; such an elevator wherein the at least one roller is a plurality of spaced apart rollers; and such an elevator wherein the plurality of one or more rollers on each body part.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. An elevator for use in wellbore operations, the elevator comprising a first body part, a second body part, the body parts together defining an interior opening through the elevator for accommodating a wellbore tubular therein, the body parts hingedly connected together and hingedly openable on a side of the elevator, at least one first roller secured to at least one of the body parts to facilitate movement of a wellbore tubular within and with respect to the elevator, wherein the at least one first roller has a roller portion thereof protruding into the interior opening for contacting an exterior surface of a wellbore tubular within the interior opening, and at least one second roller disposed beneath the first and second body parts and disposed entirely exteriorly of the interior opening to facilitate movement of a wellbore tubular with respect to the elevator.

2. A method for handling wellbore tubulars in a rig, the method comprising attaching an elevator to a wellbore tubular, the elevator comprising a first body part, a second body part, the body parts together defining an interior opening through the elevator for accommodating a wellbore tubular therein, the body parts hingedly connected together and hingedly openable on a side of the elevator, at least one first roller secured to at least one of the body parts to facilitate movement of a wellbore tubular with respect to the elevator, wherein the at least one first roller has a roller portion thereof protruding into the interior opening for contacting an exterior surface of a wellbore tubular within the interior opening, and at least one second roller disposed beneath the first and second body parts and disposed entirely exteriorly of the interior opening to facilitate movement of a wellbore tubular with respect to the elevator.

3. The method of claim 2 wherein the elevator has at least one third roller protruding into the interior opening for contacting an exterior surface of the wellbore tubular within the interior opening, the method further comprising:

facilitating movement of the wellbore tubular with the at least one third roller.

* * * * *